US012672683B2

(12) United States Patent
Gu

(10) Patent No.: US 12,672,683 B2
(45) Date of Patent: Jul. 7, 2026

(54) VEST WITH ADJUSTABLE TIGHTNESS

(71) Applicant: Dongguan Dike Sports Goods Co., Ltd., Dongguan (CN)

(72) Inventor: Pinglong Gu, Ji'an (CN)

(73) Assignee: Dongguan Dike Sports Goods Co., Ltd., Dongguan (CN)

( * ) Notice: Subject to any disclaimer, the term of this patent is extended or adjusted under 35 U.S.C. 154(b) by 0 days.

(21) Appl. No.: 18/920,882

(22) Filed: Oct. 19, 2024

(65) Prior Publication Data

US 2026/0053208 A1 Feb. 26, 2026

(30) Foreign Application Priority Data

Aug. 21, 2024 (CN) ..... 202422032682.6

(51) Int. Cl.
*A41D 1/04* (2006.01)
*A41F 15/00* (2006.01)

(52) U.S. Cl.
CPC ..... *A41D 1/04* (2013.01); *A41F 15/002* (2013.01)

(58) Field of Classification Search
CPC ..... A41D 1/04; A41F 15/002
See application file for complete search history.

(56) References Cited

U.S. PATENT DOCUMENTS

2005/0247813 A1* 11/2005 Kovacevich ..... A42B 3/14 242/395
2007/0039085 A1* 2/2007 Kovacevich ..... A41D 15/00 2/205
2017/0354530 A1* 12/2017 Shagdar ..... A41D 31/18
2020/0335005 A1* 10/2020 Green ..... A41D 1/04

* cited by examiner

*Primary Examiner* — Alissa L Hoey
*Assistant Examiner* — Akwokwo Olabisi Redhead

(57) ABSTRACT

Disclosed is a vest with adjustable tightness, which belongs to the technical field of clothes. The vest with adjustable tightness includes a garment body with shoulder straps and a zipper mounted, and also includes two adjusting belts, which are fixedly connected to the garment body, where the adjusting belts are erected on the shoulder straps, and two sides of a surface of the garment body are fixedly connected to mounting sheets; and two elastic bands, which are mounted on the back of the garment body, where the two elastic bands are distributed in a cross manner and form an X-shape. By rotating rotary knob disks, the elastic bands can be contracted and released, and the adjusting belts are tightened and loosened, such that sports personnel adjust tightness of the vest conveniently.

4 Claims, 8 Drawing Sheets

VEST WITH ADJUSTABLE TIGHTNESS

TECHNICAL FIELD

The present disclosure relates to the technical field of clothes, in particular to a vest with adjustable tightness.

BACKGROUND

Vest is a kind of short coat clothing without collars and sleeves, which is used to protect the body or keep warm. Vest can be worn inside the coat or outside the underwear. The main varieties are cotton vests, down vests, wool vests and sports vests in various shapes.

At present, in the process of exercise training, sports personnel usually wear sports vests to support and protect their bodies in order to improve the exercise effect.

When sports personnel buy sports vests, they usually buy sports vests according to the size they can wear. However, most of the current vests are fixed in size. Because the own figures of sports personnel change at different stages, they may become stronger or thinner, which makes the vests too tight or too loose when wearing, and results in the vests not fitting, thus failing to satisfy the wearing needs of sports personnel. Therefore, in order to solve the above problems, a vest with adjustable tightness is provided.

SUMMARY

An objective of the present disclosure is to provide a vest with adjustable tightness in order to solve the problem that it is inconvenient for adjustment of tightness of existing vests, which may make the vests too tight or too loose when wearing, and result in the vests not fitting, thus failing to satisfy the wearing needs of sports personnel.

In order to achieve the above objective, the present disclosure uses the following solution:

The vest with adjustable tightness includes a garment body with shoulder straps and a zipper mounted, and also includes two adjusting belts, which are fixedly connected to the garment body, the adjusting belts are erected on the shoulder straps, and two sides of a surface of the garment body are fixedly connected to mounting sheets; and two elastic bands, which are mounted on the back of the garment body, the two elastic bands are distributed in a cross manner and form an X-shape, two ends of the elastic bands are fixedly connected to one ends of the adjusting belts and surfaces of the mounting sheets separately, and adjusters for contracting and releasing the elastic bands are arranged on the mounting sheets.

In order to facilitate the adjustment of the tightness of the vest, preferably, the adjusters include: housings, which are fixedly connected to the mounting sheets, vertical rods are fixedly connected in the housings, and wire reels and rotary knob disks are sleeved on the vertical rods. Adjusting ropes pass through the elastic bands, one ends of the adjusting ropes are fixedly connected to one ends of the elastic bands close to the adjusting belts, and the other ends of the adjusting ropes penetrate into the housings and are fixedly mounted on the wire reels. Tops of the wire reels and bottoms of the rotary knob disks are fixedly connected to wedge gear rings. When bottom surfaces of the rotary knob disks are in contact with top surfaces of the housings, the two wedge gear rings are engaged with each other. When the bottom surfaces of the rotary knob disks are far away from the top surfaces of the housings, the two wedge gear rings are separated from each other, and guide members are arranged in the housings.

In order to make the wire reels rotate in one direction, further, the guide members include a plurality of arc-shaped racks and a plurality of wedge teeth, the plurality of arc-shaped racks are mounted on the rotary knob disks, and the plurality of wedge teeth are fixedly connected in the housings. When the bottom surfaces of the rotary knob disks are in contact with the top surfaces of the housings, the plurality of arc-shaped racks and the plurality of wedge teeth are engaged with each other. When the bottom surfaces of the rotary knob disks are far away from the top surfaces of the housings, the plurality of arc-shaped racks and the plurality of wedge teeth are separated from each other.

In order to enhance overall toughness of the vest, preferably, a plurality of elastic strips are fixedly mounted on the garment body, and the plurality of elastic strips are arranged on the back of the garment body in a linear manner.

In order to improve a fitting effect of a bottom of the vest, preferably, anti-slip strips are fixedly mounted at a bottom of an inner surface of the garment body, and the anti-slip strips are made of silica gel.

In order to limit the adjusting belts, preferably, the shoulder straps are fixedly connected to limiting sleeves, and the adjusting belts are inserted into the limiting sleeves.

Compared with the prior art, the present disclosure provides the vest with adjustable tightness, and has the following beneficial effects:

1. According to the vest with adjustable tightness, by rotating the rotary knob disks, the elastic bands may be contracted and released, and the adjusting belts are tightened and loosened, such that sports personnel adjust the tightness of the vest conveniently. The operation is very convenient, such that the vest may be adjusted adaptively according to the change of figure of the sports personnel, the vest fits better, and then wearing requirements of the sports personnel are satisfied.
2. According to the vest with adjustable tightness, by means of cooperative usage of the plurality of arc-shaped racks and the plurality of wedge teeth, the wire reels may be limited, such that the wire reels may only rotate in one direction, the wound adjusting ropes and the contracted elastic bands are prevented from being released under the action of external force, and then use stability of the vest after adjustment is improved.

The parts not involved in the device are the same as the prior art or may be realize by the prior art, the present disclosure solves the problem that it is inconvenient for adjustment of the tightness of the existing vests, which may make the vests too tight or too loose when wearing, and result in the vests not fitting, thus failing to satisfy the wearing needs of the sports personnel.

In the figures: 1. garment body; 2. shoulder strap; 3. zipper; 4. adjusting belt; 5. mounting sheet; 6. elastic band; 7. elastic strip; 8. adjusting rope; 9. adjuster; 91. housing; 92. vertical rod; 93. wire reel; 94. rotary knob disk; 95. wedge gear rings; 96. plurality of arc-shaped racks; 97. plurality of wedge teeth; 10. anti-slip strip; 11. limiting sleeve.

DETAILED DESCRIPTIONS OF THE EMBODIMENTS

The technical solution in the examples of the present disclosure is clearly and completely described below with reference to the accompanying drawings in the examples of the present disclosure. Apparently, the described examples are some rather than all of the examples of the present disclosure.

In the description of the present application, it needs to be understood the orientation or positional relationships indicated by the terms "up", "down", "front", "rear", "left", "right", "top", "bottom", "inside", "outside", etc. are based on the orientation or positional relationship shown in the accompanying drawings, are merely for facilitating the description of the present disclosure and simplifying the description, rather than indicating or implying that an apparatus or element referred to must have a particular orientation or be constructed and operated in a particular orientation, and therefore will not be interpreted as limiting the present disclosure.

Example

Figure 1:
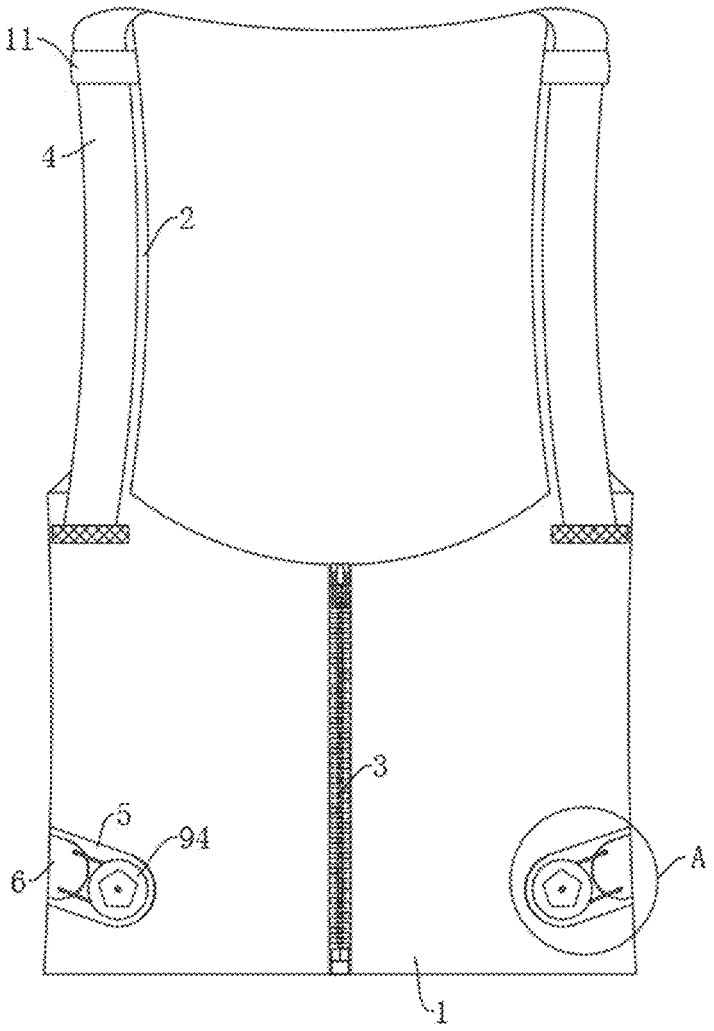
FIG. 1 is a schematic structural diagram of a vest with adjustable tightness provided by the present disclosure from a front view.
Figure 2:
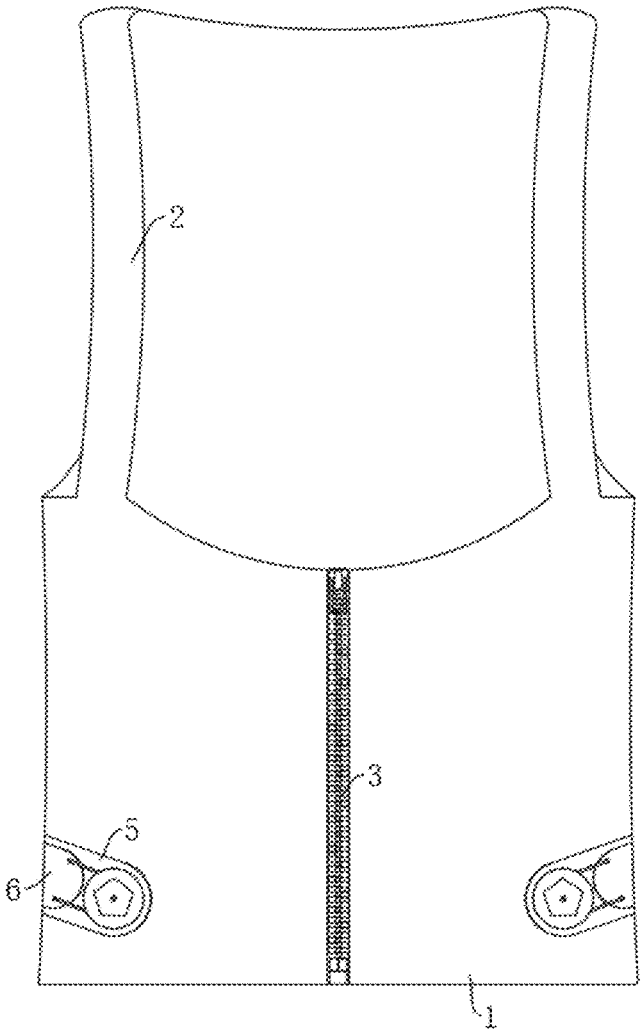
FIG. 2 is a partial schematic structural diagram of the vest with adjustable tightness provided by the present disclosure from a front view.
Figure 3:
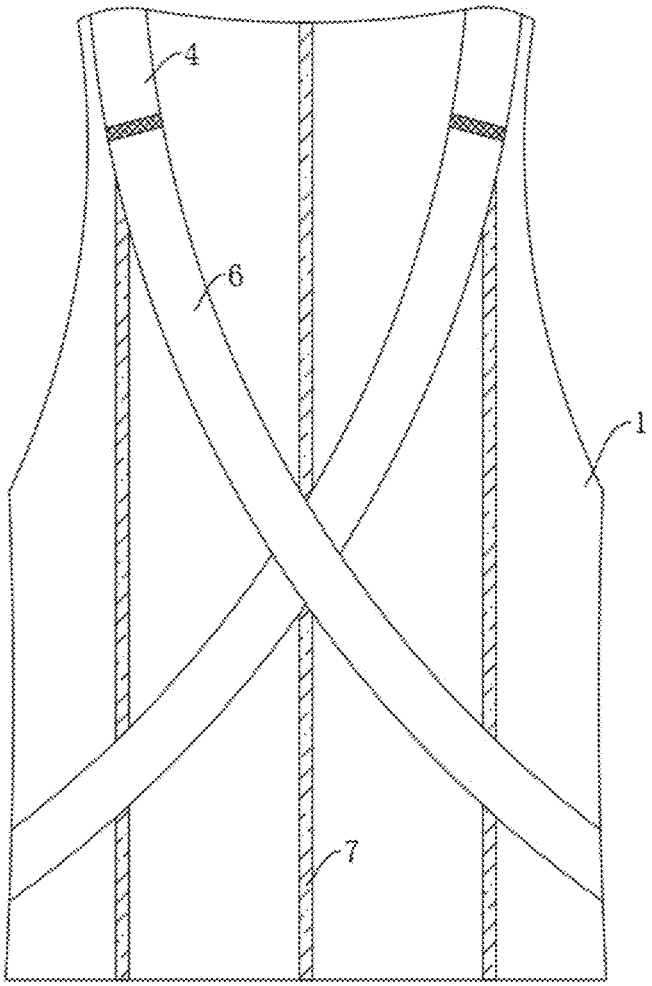
FIG. 3 is a schematic structural diagram of the vest with adjustable tightness provided by the present disclosure from a rear view.
Figure 4:
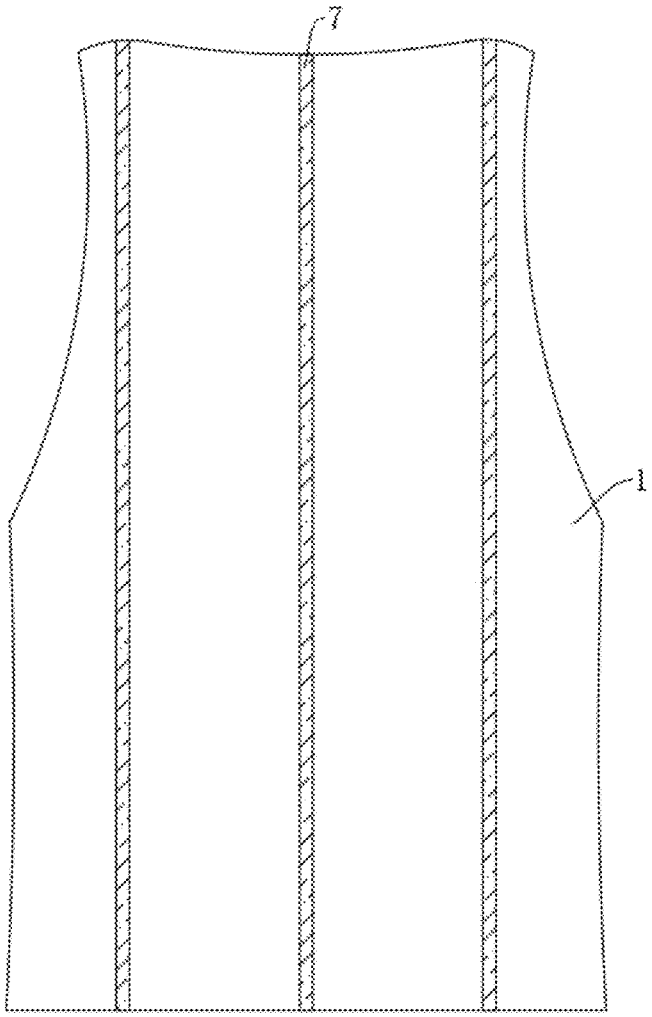
FIG. 4 is a partial schematic structural diagram of the vest with adjustable tightness provided by the present disclosure from a rear view.
Figure 5:
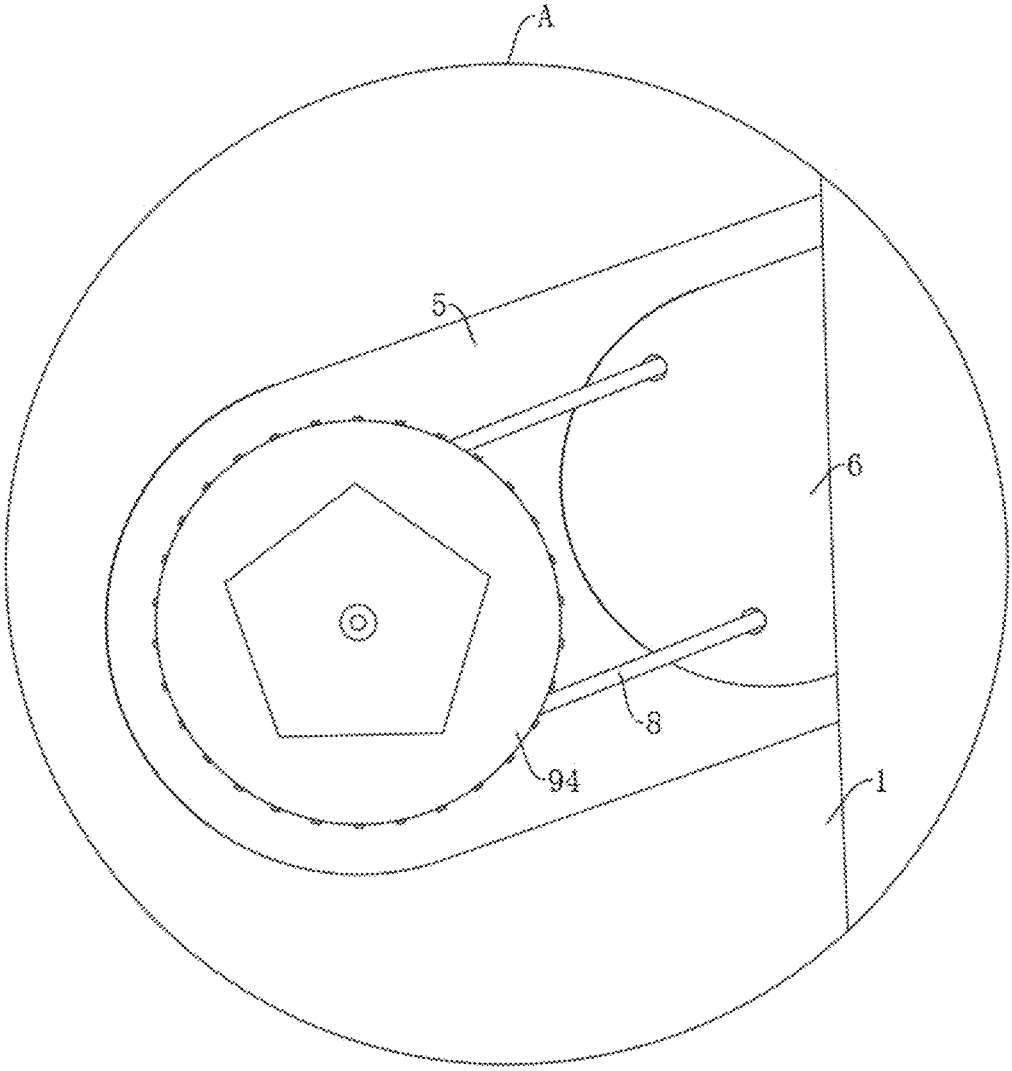
FIG. 5 is an enlarged schematic structural diagram of a portion A in FIG. 1 of the vest with adjustable tightness provided by the present disclosure from a front view.
Figure 6:
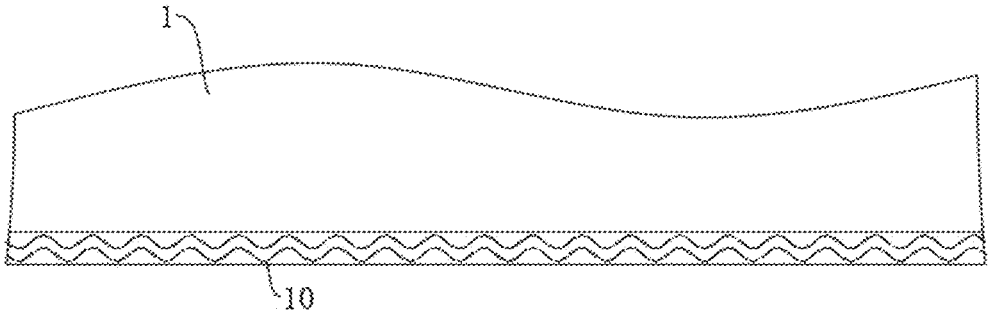
FIG. 6 is a schematic structural diagram of anti-slip strips of the vest with adjustable tightness provided by the present disclosure.
Figure 7:
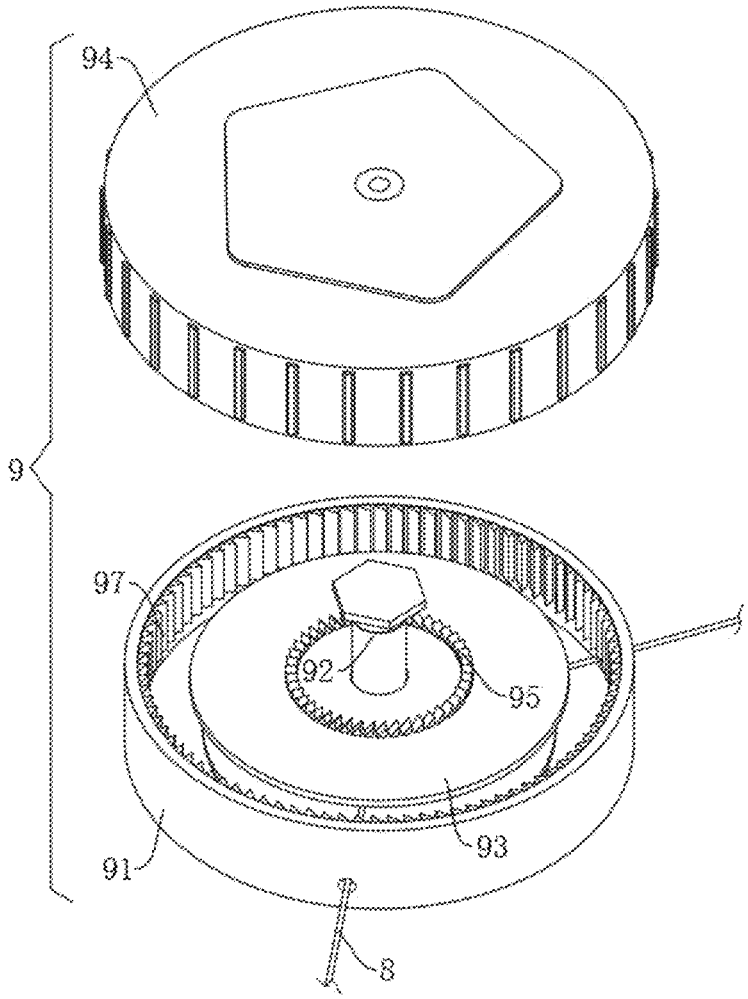
FIG. 7 is an explosive view of adjusters of the vest with adjustable tightness provided by the present disclosure from a first perspective.
Figure 8:
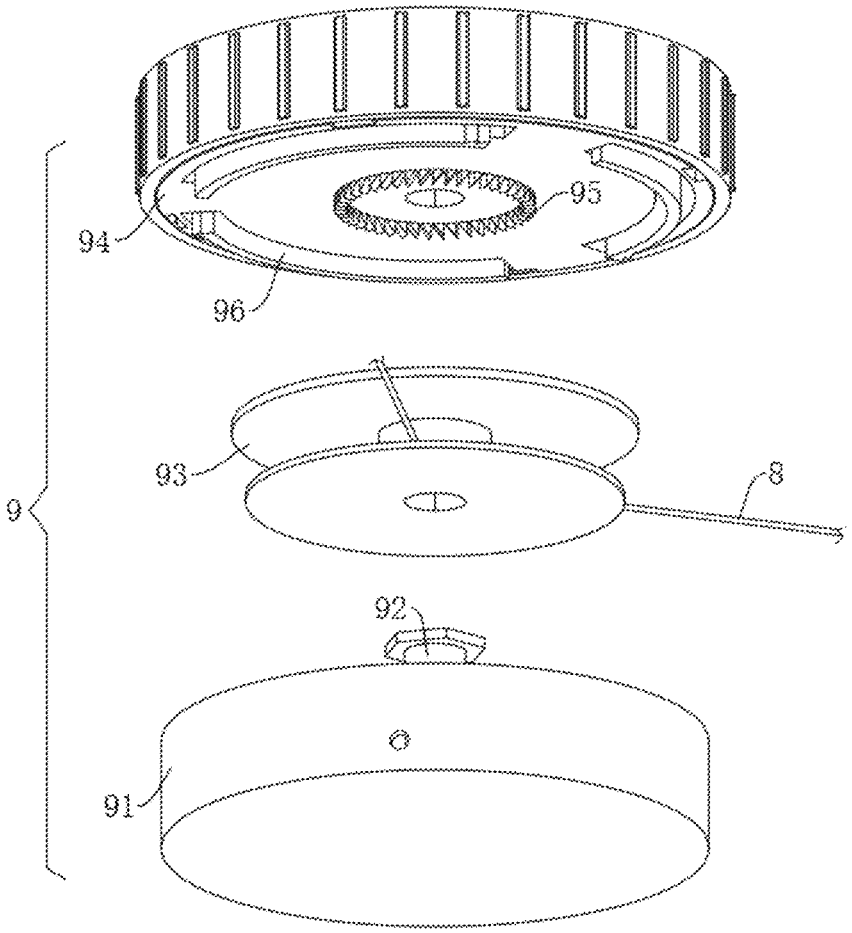
FIG. 8 is an explosive view of the adjusters of the vest with adjustable tightness provided by the present disclosure from a second perspective.

With reference to FIG. 1-FIG. 8, a vest with adjustable tightness is provided by the example of the present disclosure and includes a garment body 1 with shoulder straps 2 and a zipper 3 mounted, the garment body 1 is similar to a waistcoat or little vest. The vest further includes: two adjusting belts 4, which are fixedly connected to the garment body 1. The adjusting belts 4 are erected on the shoulder straps 2, the garment body 1, the shoulder straps 2 and the adjusting belts 4 are made of elastic materials, which may be spandex or polyester, and two sides of a surface of the garment body 1 are fixedly connected to mounting sheets 5. The vest includes: two elastic bands 6, which are mounted on the back of the garment body 1, the two elastic bands 6 are distributed in a cross manner and form an X-shape, two ends of the elastic bands 6 are fixedly connected to one ends of the adjusting belts 4 and surfaces of the mounting sheets 5 separately, and adjusters 9 for contracting and releasing the elastic bands 6 are arranged on the mounting sheets 5.

Specifically, when in use, by arranging the adjusters 9, the elastic bands 6 may be contracted and released, and the adjusting belts 4 are tightened and loosened, such that sports personnel adjust tightness of the vest conveniently. The vest may be adjusted adaptively according to the change of figure of the sports personnel, such that the vest fits better, and then wearing requirements of the sports personnel are satisfied.

The adjusters include: housings 91, which are fixedly connected to the mounting sheets 5, vertical rods 92 are fixedly connected in the housings 91, and wire reels 93 and rotary knob disks 94 are sleeved on the vertical rods 92. Adjusting ropes 8 pass through the elastic bands 6, one ends of the adjusting ropes 8 are fixedly connected to one ends of the elastic bands 6 close to the adjusting belts 4, and the other ends of the adjusting ropes 8 penetrate into the housings 91 and are fixedly mounted on the wire reels 93. Tops of the wire reels 93 and bottoms of the rotary knob disks 94 are fixedly connected to wedge gear rings 95. When bottom surfaces of the rotary knob disks 94 are in contact with top surfaces of the housings 91, the two wedge gear rings 95 are engaged with each other. When the bottom surfaces of the rotary knob disks 94 are far away from the top surfaces of the housings 91, the two wedge gear rings 95 are separated from each other, and guide members are arranged in the housings 91.

Specifically, when in use, when the bottom surfaces of the rotary knob disks 94 are in contact with the top surfaces of the housings 91, by rotating the rotary knob disks 94 and driving the wedge gear rings 95 and the wire reels 93 to rotate together, the adjusting ropes 8 may be wound around the wire reels 93 conveniently. The elastic bands 6 are driven to be contracted, and further, the adjusting belts 4 are driven to be tightened, such that the tightness of the vest is adjusted.

The guide members include plurality of arc-shaped racks 96 and plurality of wedge teeth 97, the plurality of arc-shaped racks 96 are mounted on the rotary knob disks 94, and the plurality of wedge teeth 97 are fixedly connected in the housings 91. When the bottom surfaces of the rotary knob disks 94 are in contact with the top surfaces of the housings 91, the plurality of arc-shaped racks 96 and the plurality of wedge teeth 97 are engaged with each other. When the bottom surfaces of the rotary knob disks 94 are far away from the top surfaces of the housings 91, the plurality of arc-shaped racks 96 and the plurality of wedge teeth 97 are separated from each other.

Specifically, when in use, when the bottom surfaces of the rotary knob disks 94 are in contact with the top surfaces of the housings 91, by rotating the wire reels 93 and driving the plurality of arc-shaped racks 96 to slide along gear inclination slopes of the plurality of wedge teeth 97 by means of the ratchet principle, the wire reels 93 may only rotate in one direction, such that the wound adjusting ropes 8 are prevented from being released under the action of external force.

In addition, when the bottom surfaces of the rotary knob disks 94 are far away from the top surfaces of the housings 91, the two wedge gear rings 95 are separated from each other at this time, the plurality of arc-shaped racks 96 and the plurality of wedge teeth 97 are separated from each other, such that one-way limitation of the wire reels 93 may be released, then a user releases the adjusting ropes 8 wound around the wire reels 93 conveniently, and further, the elastic bands 6 are releases.

Damping is arranged between the rotary knob disks 94 and the vertical rods 92, such that the rotary knob disks 94 may have a certain frictional resistance on the vertical rods 92, and the rotary knob disks 94 may be prevented from freely sliding along surfaces of the vertical rods 92 without being forced.

A plurality of elastic strips 7 are fixedly mounted on the garment body 1, the plurality of elastic strips 7 are arranged on the back of the garment body 1 in a linear manner, and the three elastic strips 7 are arranged.

Specifically, by means of the arrangement of the elastic strips 7, the garment body 1 may be elastically supported, such that overall toughness of the vest is enhanced, the sports personnel wear the vest conveniently, and a supporting effect is improved.

Anti-slip strips 10 are fixedly mounted at a bottom of an inner surface of the garment body 1, and the anti-slip strips 10 are made of silica gel.

Specifically, by means of the arrangement of the anti-slip strips 10, the fitting effect of the bottom of the vest may be improved, such that a wearing effect is realized The shoulder straps 2 are fixedly connected to limiting sleeves 11, and the adjusting belts 4 are inserted into the limiting sleeves 11.

Specifically, by means of the arrangement of the limiting sleeves 11, the adjusting belts 4 may be limited, such that the adjusting belts 4 are prevented from slipping from the shoulder straps 2.

Working principle: during the use of the vest with adjustable tightness, when the bottom surfaces of the rotary knob disks 94 are in contact with the top surfaces of the housings 91, by rotating the rotary knob disks 94 and driving the wedge gear rings 95 and the wire reels 93 to rotate together, the adjusting ropes 8 may be wound around the wire reels 93 conveniently. In a winding process, the adjusting ropes 8 drive the elastic bands 6 to be contracted and the adjusting belts 4 to be tightened, such that the tightness of the vest is adjusted. Further, by rotating the wire reels 93 and also driving the plurality of arc-shaped racks 96 to slide along the gear inclination slopes of the plurality of wedge teeth 97 by means of the ratchet principle, the wire reels 93 may only rotate in one direction, such that the wound adjusting ropes 8 and the contracted elastic bands 6 are prevented from being released under the action of external force.

Then, by pulling the rotary knob disks 94, the rotary knob disks slide along the surfaces of the vertical rods 92, the bottom surfaces of the rotary knob disks 94 are far away from the top surfaces of the housings 91. The two wedge gear rings 95 are separated from each other at this time, and the plurality of arc-shaped racks 96 and the plurality of wedge teeth 97 are separated from each other, such that one-way limitation of the wire reels 93 may be released. Then, the elastic bands 6 are pulled, such that the wound adjusting ropes 8 and the contracted elastic bands 6 are released.

According to the vest, by rotating the rotary knob disks 94, the elastic bands 6 may be contracted and released, and the adjusting belts 4 are tightened and loosened, such that the sports personnel adjust the tightness of the vest conveniently. The operation is very convenient, such that the vest may be adjusted adaptively according to the change of figure of the sports personnel, the vest fits better, and then wearing requirements of the sports personnel are satisfied.

The above examples are only further particular embodiments of the present disclosure, but the scope of protection of the present disclosure is not limited to the above examples; and anyone skilled in the art makes equivalent substitutions or variations according to the technical solution of the present disclosure and the concepts thereof within the technical scope disclosed in the present disclosure, and all the substitutions or variations fall within the scope of protection of the present disclosure.

What is claimed is:

1. A vest with adjustable tightness, comprising:

a garment body having shoulder straps and a zipper;

two adjusting belts fixedly connected to the garment body and provided on the shoulder straps; mounting sheets fixedly connected to opposite sides of a surface of the garment body;

two elastic bands mounted on a back of the garment body, the two elastic bands being arranged in a cross to form an X-shape, wherein ends of the elastic bands are fixedly connected respectively to ends of the adjusting belts and to surfaces of the mounting sheets; and adjusters arranged on the mounting sheets for contracting and releasing the elastic bands;

wherein each adjuster comprises a housing fixedly attached to a respective mounting sheet, a vertical rod fixedly provided at a center of the housing, a wire reel and a rotary knob disk sleeved on the vertical rod, and an adjusting rope threaded through a corresponding elastic band, a first end of the adjusting rope being fixedly connected to an end of the elastic band close to the adjusting belt and a second end of the adjusting rope being inserted into the housing and fixedly mounted on the wire reel;

wherein a top of the wire reel and a bottom of the rotary knob disk are fixedly provided with wedge gear rings such that, when the rotary knob disk is rotated and moved downward until the bottom of the rotary knob disk contacts the top of the wire reel, the wedge gear rings engage each other, and when the rotary knob disk is rotated and moved upward so that the bottom of the rotary knob disk is no longer in contact with the top of the wire reel, the wedge gear rings are separated; and wherein the bottom of the rotary knob disk is further provided with a plurality of arc-shaped racks, and an inner wall of the housing is provided with a plurality of wedge teeth such that, when the rotary knob disk is rotated and moved downward until the bottom of the rotary knob disk contacts the inner wall of the housing, the arc-shaped racks and the wedge teeth are engaged, and when the rotary knob disk is rotated and moved upward so that the bottom of the rotary knob disk is no longer in contact with the inner wall of the housing, the arc-shaped racks and the wedge teeth are separated.

2. The vest with adjustable tightness according to claim 1, wherein a plurality of elastic strips are fixedly mounted on the garment body, and the plurality of elastic strips are arranged on the back of the garment body in a linear manner.

3. The vest with adjustable tightness according to claim 1, wherein anti-slip strips are fixedly mounted at a bottom of an inner surface of the garment body, and the anti-slip strips are made of silica gel.

4. The vest with adjustable tightness according to claim 1, wherein the shoulder straps are fixedly connected to limiting sleeves, and the adjusting belts are inserted into the limiting sleeves.

* * * * *